US011674744B2

(12) United States Patent
Kiziltepe et al.

(10) Patent No.: US 11,674,744 B2
(45) Date of Patent: Jun. 13, 2023

(54) DIVIDER ASSEMBLY WITH A SLIDER FOR A COOLING DEVICE AND COOLING DEVICE HAVING A DIVIDER ASSEMBLY

(71) Applicant: BSH Hausgeraete GmbH, Munich (DE)

(72) Inventors: Nagihan Kiziltepe, Tekirdag (TR); Mert Oezer, Tekirdag (TR); Mustafa Emin Yildirim, Tekirdag (TR)

(73) Assignee: BSH Hausgeraete GmbH, Munich (DE)

( * ) Notice: Subject to any disclaimer, the term of this patent is extended or adjusted under 35 U.S.C. 154(b) by 0 days.

(21) Appl. No.: 17/556,174

(22) Filed: Dec. 20, 2021

(65) Prior Publication Data

US 2022/0196318 A1 Jun. 23, 2022

(30) Foreign Application Priority Data

Dec. 22, 2020 (TR) ..... 2020/21196

(51) Int. Cl.
*F25D 23/04* (2006.01)

(52) U.S. Cl.
CPC ..... *F25D 23/04* (2013.01)

(58) Field of Classification Search
CPC .... F25D 23/04; F25D 25/02; F25D 2325/021; F25D 2331/803; F25D 25/04; A47B 88/493; A47B 88/487; A47B 2210/0032; A47B 2210/0035; A47B 2210/0097; A47B 2210/004; A47B 88/437; F16C 33/38
USPC ..... 211/184
See application file for complete search history.

(56) References Cited

U.S. PATENT DOCUMENTS 3,944,302 A * 3/1976 Fourrey ..... B60N 2/0705 384/47
4,089,568 A * 5/1978 Fall ..... A47B 88/487 384/18
4,112,539 A * 9/1978 Hagen ..... F16C 29/005 16/88
4,475,778 A * 10/1984 Stark ..... A47B 88/487 312/334.1
4,770,314 A * 9/1988 Giesler ..... F25D 23/04 220/544
4,921,359 A * 5/1990 Sakamoto ..... F16C 29/04 312/334.17
5,269,600 A * 12/1993 Arreola ..... A47B 88/90 312/348.3

(Continued)

*Primary Examiner* — Hiwot E Tefera
(74) *Attorney, Agent, or Firm* — Laurence A. Greenberg; Werner H. Sterner; Ralph E. Locher

(57) ABSTRACT

A divider assembly to be mounted in a storage container for dividing the storage container during use, includes a guiding rail having a first surface and a second surface facing each other and extending in a sliding direction, a slider slidably movable in the guiding rail, and a divider attached to the slider and movable with the slider in the storage container for dividing the storage container into sections. The slider includes at least two slider arms extending in opposite directions. Each slider arm has at least one ball-shaped roller. The ball-shaped rollers roll on at least one of the first surface or second surface of the guiding rail when the divider assembly moves in the sliding direction. A cooling device including the divider assembly is also provided.

12 Claims, 7 Drawing Sheets

(56) References Cited

U.S. PATENT DOCUMENTS

| | | | | | |
|---|---|---|---|---|---|
| 5,366,283 | A * | 11/1994 | Crose | B42F 17/14 | 220/548 |
| 5,626,405 | A * | 5/1997 | Banks | A47B 88/49 | 312/334.44 |
| 5,895,101 | A * | 4/1999 | Cabrales | A47B 88/493 | 312/334.17 |
| 7,104,692 | B1 * | 9/2006 | Lu | F16C 29/04 | 384/49 |
| 10,451,339 | B1 * | 10/2019 | Wantland | F25D 23/069 | |
| 2005/0067929 | A1 * | 3/2005 | Gilman | F25D 23/04 | 312/405.1 |
| 2006/0152123 | A1 * | 7/2006 | Collins | A47B 57/586 | 312/405.1 |
| 2010/0319391 | A1 * | 12/2010 | Lim | A47B 88/975 | 62/449 |
| 2019/0178566 | A1 * | 6/2019 | Cordero | F25D 11/02 | |
| 2019/0357679 | A1 * | 11/2019 | Li | F25D 25/022 | |
| 2019/0383498 | A1 * | 12/2019 | Tremolieres | F16C 33/38 | |
| 2020/0240467 | A1 * | 7/2020 | Oishi | A47B 88/483 | |
| 2021/0341215 | A1 * | 11/2021 | Kang | F16C 29/04 | |
| 2022/0243973 | A1 * | 8/2022 | Kim | F25C 5/18 | |

* cited by examiner

DIVIDER ASSEMBLY WITH A SLIDER FOR A COOLING DEVICE AND COOLING DEVICE HAVING A DIVIDER ASSEMBLY

CROSS-REFERENCE TO RELATED APPLICATION

This application claims the priority, under 35 U.S.C. § 119, of Turkish Patent Application TR 2020/21196, filed Dec. 22, 2020; the prior application is herewith incorporated by reference in its entirety.

FIELD AND BACKGROUND OF THE INVENTION

The present invention relates to a divider assembly to be mounted in a storage container for dividing the storage container during use, the divider assembly including a guiding rail having a first surface and a second surface facing each other and extending in a sliding direction, a slider slidably movable in the guiding rail, and a divider attached to the slider and movable with the slider in the storage container for dividing the storage container into sections.

Storage containers are used for storing articles. Storage containers can be used with a divider dividing the storage container into different areas in order to create flexible usage volumes in the storage containers. Storage containers are used in cooling devices (i.e., refrigerators) as well.

The divider used in the storage container, which is mounted on a door of the cooling device, is used for supporting the articles in a certain position while opening and closing the door. There are dividers that can move in the storage containers. A movable divider assembly has a slider and a guiding rail for moving the divider. In the state of the art, divider assemblies used in storage containers are not moved easily by the user due to high friction between the slider and the guiding rail.

A prior art publication in the technical field of the invention which may be referred to is U.S. Pat. No. 10,451,339 B1, which discloses an adjustable divider, that is slidably mounted on the storage container on the door by rollers.

SUMMARY OF THE INVENTION

It is accordingly an object of the invention to provide a divider assembly with a slider for a cooling device and a cooling device having a divider assembly, which overcome the hereinafore-mentioned disadvantages of the heretofore-known assemblies and devices of this general type and in which the divider assembly is made easier to move in the storage container.

With the foregoing and other objects in view there is provided, in accordance with the invention, a divider assembly to be mounted in a storage container for dividing the storage container, the divider assembly comprising a guiding rail having a first surface and a second surface aligned facing each other and extending in a sliding direction, a slider slidably movable in the guiding rail, and a divider attached to the slider and movable with the slider in the storage container for dividing the storage container into sections. The divider is attached to the slider by a screw. The slider includes at least two slider arms extending in opposite direction, each slider arm having at least one ball-shaped roller, the ball-shaped rollers rolling on at least one of the first surface or the second surface of the guiding rail when the slider is moved in the sliding direction. The slider has an upper surface that faces the second surface of the guiding rail and a lower surface that faces the first surface of the guiding rail when the slider is moved on the guiding rail. The first ball-shaped rollers are placed on the lower surface of the slider. The second ball-shaped rollers are placed on the upper surface of the slider. Since one or more ball-shaped rollers are used for moving the slider on the guiding rail, the friction between the slider and the first and second surfaces of the guiding rail is reduced. Therefore, the force needed for moving the slider is reduced. Therefore, the slider slides smoothly on the guiding rail when the divider is moved in the storage container by the user.

In a possible embodiment, each slider arm has at least one first ball-shaped roller rolling on the first surface of the guiding rail when the divider is moved in the sliding direction and at least one slider arm has at least one second ball-shaped roller rolling on the second surface of the guiding rail when the divider is moved in the sliding direction. One slider arm has one first ball-shaped roller and one second ball-shaped roller. The other slider arm has only one first ball-shaped roller. Preferably, four ball-shaped rollers are placed on the slider. The first ball-shaped roller and second ball-shaped roller are placed on each slider arm so as to be oriented oppositely. Thus, the center of gravity of the divider assembly is balanced.

In another possible embodiment, the slider has a tab housing into which the divider is attached. The divider is removably mounted to the slider. Thus, the connection between the slider and the divider is simplified.

In a further possible embodiment, the divider has a connection tab for connection of the divider to the tab housing. The connection tab is fitted into the tab housing. In an added possible embodiment, the connection tab is screwed to the slider. Thus, the divider is mounted to the slider securely.

In an additional possible embodiment, at least one support member is disposed on the slider so as to support at least one of the first ball-shaped roller to the first surface of the guiding rail or to support the second ball-shaped roller to the second surface of the guiding rail. The support member supports the ball-shaped rollers flexibly. Thus, ball-shaped rollers of different sizes can be placed on the slider.

In another possible embodiment, the support member includes a first flexible protrusion that supports the first ball-shaped roller against the first surface of the guiding rail and a second flexible protrusion that supports the second ball-shaped roller against the second surface of the guiding rail. Thus, the ball-shaped rollers are supported against the surfaces of the guiding rail.

In a further possible embodiment, the support member has a recess between the first flexible protrusion and the second flexible protrusion. Thus, the flexibility of the first flexible protrusion and the second flexible protrusion is increased.

In an additional possible embodiment, each slider arm has at least one cut-out portion for cost reduction of the production of the slider arm. Each slider arm has two cut-out portions. Thus, the production cost of the slider arm is reduced.

In another possible embodiment, the guiding rail almost extends all along the storage container. Thus, the divider can be moved along the storage container by the user.

In a further possible embodiment, each slider arm has oppositely oriented roller housings for accommodating the first ball-shaped roller and the second ball-shaped roller. Thus, the ball-shaped rollers are prevented from falling from the slider.

In an added possible embodiment, the guiding rail has a C-shaped cross-section. Thus, the slider is prevented from being derailed when the slider rolls on the guiding rail.

With the objects of the invention in view, there is also provided a cooling device which comprises the divider assembly.

In a possible embodiment, the cooling device has a body, a door providing access into the body, and the storage container is mounted onto the door. The divider assembly is provided on the storage container of the cooling device. The divider being used in the storage container, which is mounted on a door of the cooling device, is used for supporting the articles in a position while opening and closing the door. Thus, the articles in the storage container are prevented from being tilted over.

In a concomitant possible embodiment, the storage container has a bottom wall that extends perpendicularly with respect to the door when the storage container is mounted onto the door and the guiding rail is disposed on a rear edge where the door intersects the bottom wall. Thus, the usage area of the storage container where the divider assembly is mounted is made functional for the user.

Other features which are considered as characteristic for the invention are set forth in the appended claims.

Although the invention is illustrated and described herein as embodied in a divider assembly having a slider for a cooling device and a cooling device having a divider assembly, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings. The accompanying drawings are provided solely for the purpose of exemplifying the invention, the advantages of which over prior art were outlined above and will be explained in detail hereinafter.

DETAILED DESCRIPTION OF THE INVENTION

Figure 1:
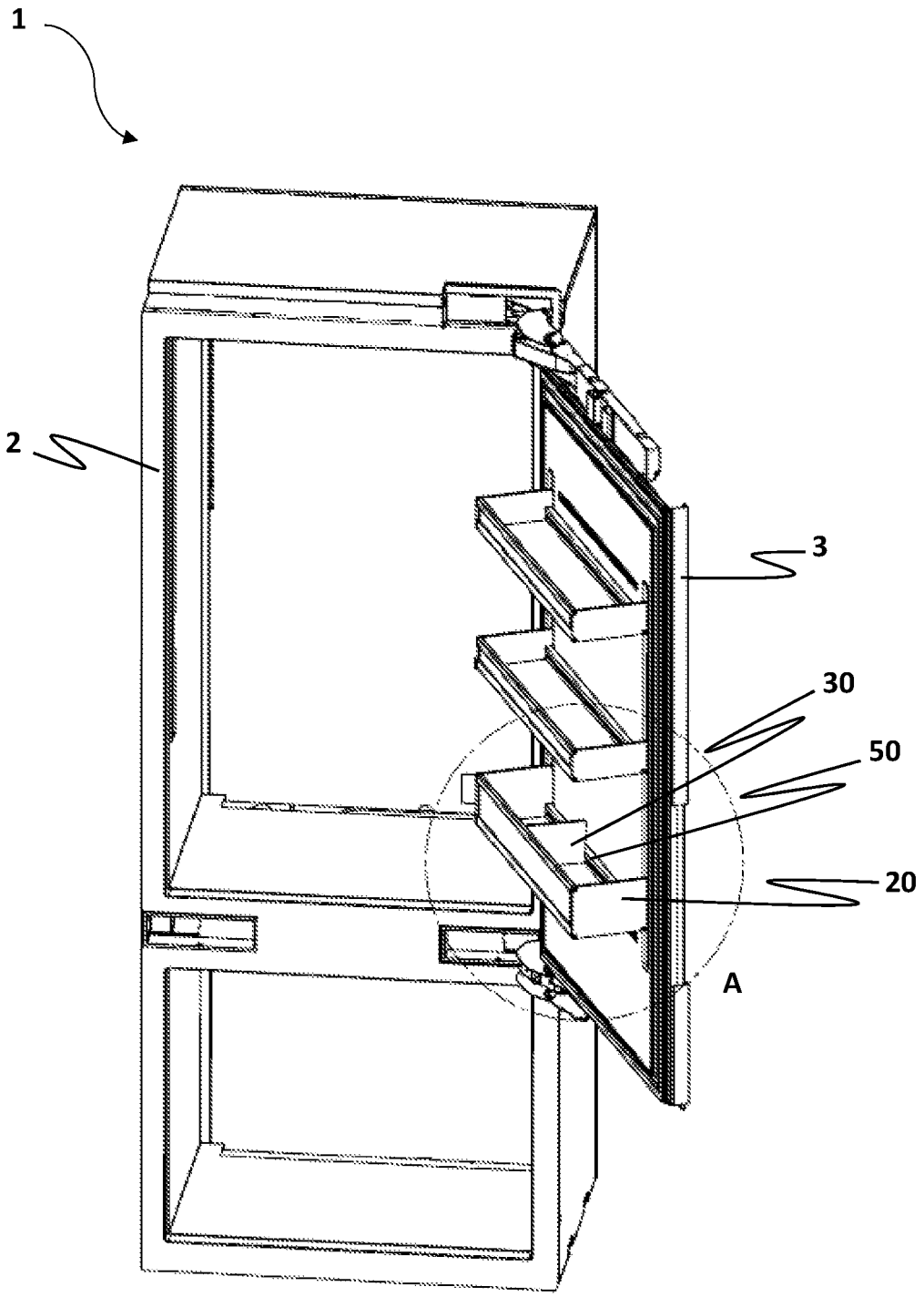
FIG. 1 is a diagrammatic, perspective view of the cooling device including the divider assembly according to the present invention.

Referring now in detail to the figures of the drawings as a whole, it is seen that the present invention proposes a divider assembly 10 which, in use, is mounted in a storage container 20 for dividing the storage container 20. The divider assembly 10 includes a guiding rail 50 that has a first surface 51 and a second surface 52 aligned facing each other and extending in a sliding direction X. The divider assembly 10 also includes a slider 40 which is slidably movable in the guiding rail 50. A divider 30 is attached to the slider 40 and movable with the slider 40 in the storage container 20 for dividing the storage container 20 into sections. The guiding rail 50, which is produced by extrusion from aluminum-based material, is provided on the storage container 20. The slider 40 includes at least two slider arms 42 extending in opposite directions, each slider arm 42 having at least one ball-shaped roller 43, 44. The ball-shaped rollers 43, 44 roll on the first surface 51 or the second surface 52 of the guiding rail 50 when the divider assembly 10 is moved in the sliding direction X. The divider 30 is attached to the slider 40 in a direction perpendicular to the sliding direction X. Preferably, the divider 30 is attached to the slider 40 so as to be between the two slider arms 42. As seen in FIGS. 4-7, the first ball-shaped roller 43 is placed on the slider 40 so as to protrude downwardly from the slider 40. The second ball-shaped roller 44 is placed on the slider 40 so as to protrude upwardly from the slider 40. The first surface 51 and the second surface 52 contact the first ball-shaped roller 43 and the second ball-shaped roller 44, respectively, when the slider 40 is moved on the guiding rail 50. The first ball-shaped roller 43 rolls on the first surface 51 of the guiding rail 50 and the second ball-shaped roller 44 rolls on the second surface 52 of the guiding rail 50 when the slider 40 is moved in the sliding direction X.

Figure 7:
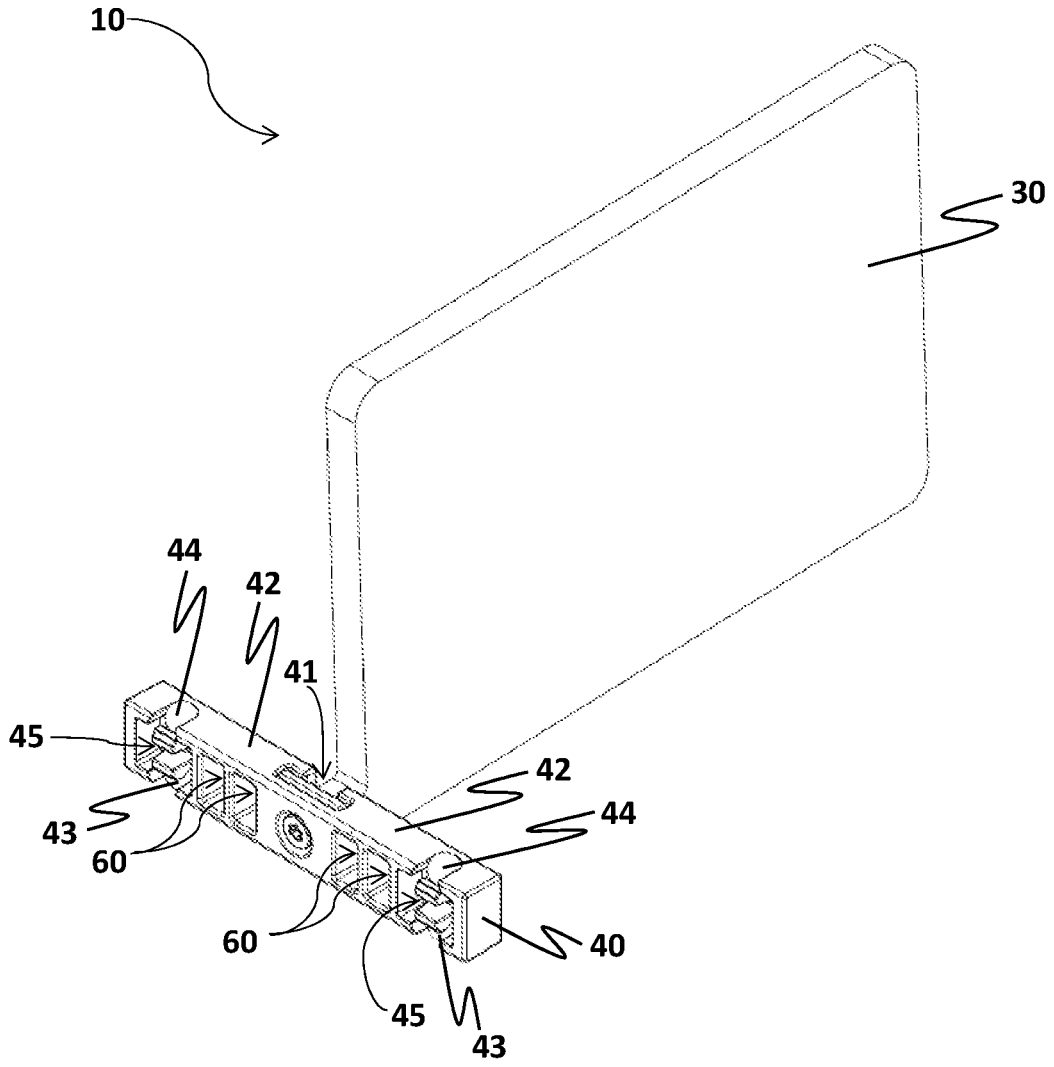
FIG. 7 is a perspective view of the divider and the slider according to the present invention.

Referring to FIG. 7, each slider arm 42 has at least one first ball-shaped roller 43 rolling on the first surface 51 of the guiding rail 50 when the divider 30 is moved in the sliding direction X. At least one slider arm 42 has at least one second ball-shaped roller 44 rolling on the second surface 52 of the guiding rail 50 when the divider 30 is moved in the sliding direction X. At least three ball-shaped rollers 43, 44 are placed on the slider 40. Preferably, four ball-shaped rollers 43, 44 are placed on the slider 40. Each slider arm 42 has one first ball-shaped roller 43 and one second ball-shaped roller 44. The first ball-shaped roller(s) 43 are placed on each slider arm 42 so as to be under the second ball-shaped roller 44.

Figure 4:
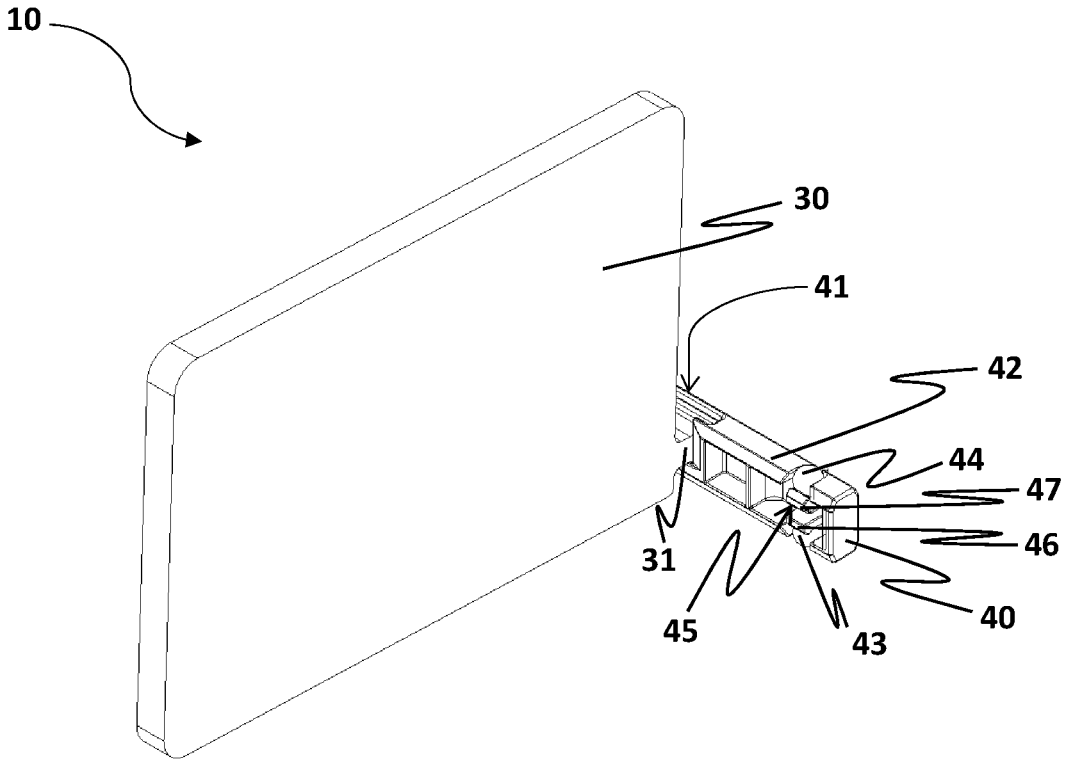
FIG. 4 is a perspective view of the divider and the slider according to the present invention.

Referring to FIG. 4 and FIG. 7, the slider 40 has a tab housing 41 into which the divider 30 is attached. The tab housing 41 is provided on the divider 30 so as to be between the slider arms 42. The tab housing 41 is in the form of a crosswise recess. The divider 30 has a connection tab 31 for connection of the divider 30 to the tab housing 41. The connection tab 31 protrudes outwardly from the slider 40. Both the connection tab 31 and the tab housing 41 are sized and shaped to engage each other.

As seen in FIG. 7, at least one support member 45 is disposed on the slider 40 so as to support the first ball-shaped roller 43 toward the first surface 51 of the guiding rail 50 and/or to support the second ball-shaped roller 44 toward the second surface 52 of the guiding rail 50. The support member 45 is produced from an elastic material. Since the guiding rail 50 is produced by extrusion from aluminum-based material, the distance between the first surface 51 and the second surface 52 can change during use depending on temperature. The support member 45 behaves like a spring to cover the dimensional change on the guiding rail 50. Therefore, an increase in friction between the ball-shaped rollers 43, 44 and the first surface 51 and the second surface 52 is prevented when the distance between the first surface 51 and the second surface 52 is decreased.

Figure 5:
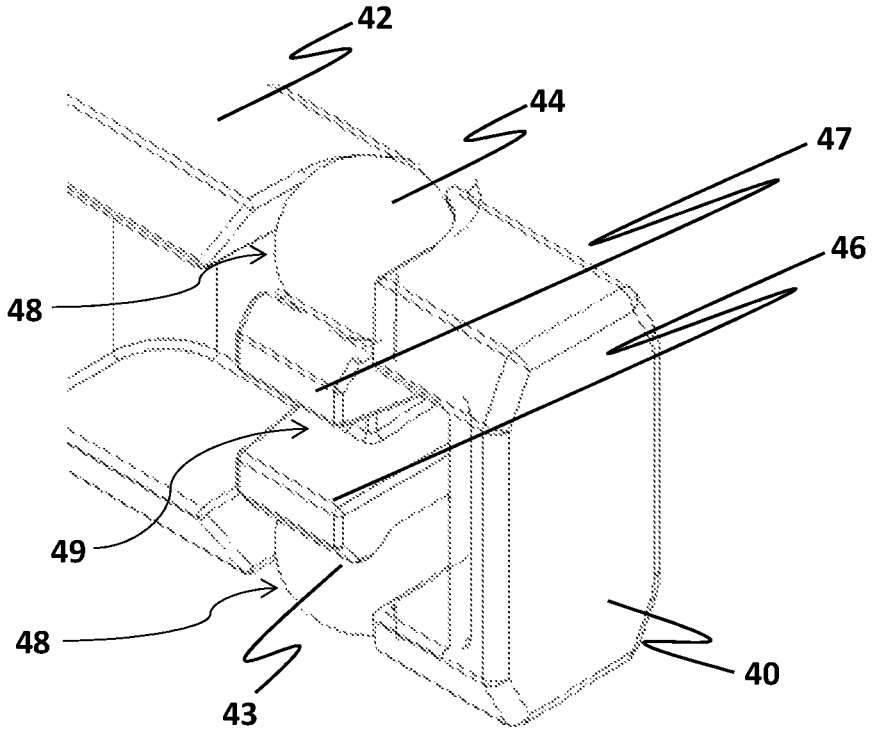
FIG. 5 is a fragmentary, perspective view of the slider arm having the roller housings and the support member according to the present invention.

As seen in FIG. 5, the support member 45 includes a first flexible protrusion 46 which supports the first ball-shaped roller 43 against the first surface 51 of the guiding rail 50 and a second flexible protrusion 47 which supports the second ball-shaped roller 44 against the second surface 52 of the guiding rail 50. The first ball-shaped roller 43 is rotatably placed on the first flexible protrusion 46. Similarly, the second ball-shaped roller 44 is rotatably placed on the second flexible protrusion 47. Both the first and the second flexible protrusions 46, 47 are sized and shaped to grip the ball-shaped rollers 43, 44 on the flexible protrusions 46, 47. Preferably, the first flexible protrusion 46 and the second flexible protrusion 47 are produced as one-piece. The first flexible protrusion 46 is formed on the support member 45 so as to be under the second flexible protrusion 47. The first flexible protrusion 46 and the second flexible protrusion 47 flex so as to decrease the distance between each other when the distance between the first surface 51 and the second surface 52 is decreased.

Figure 6:
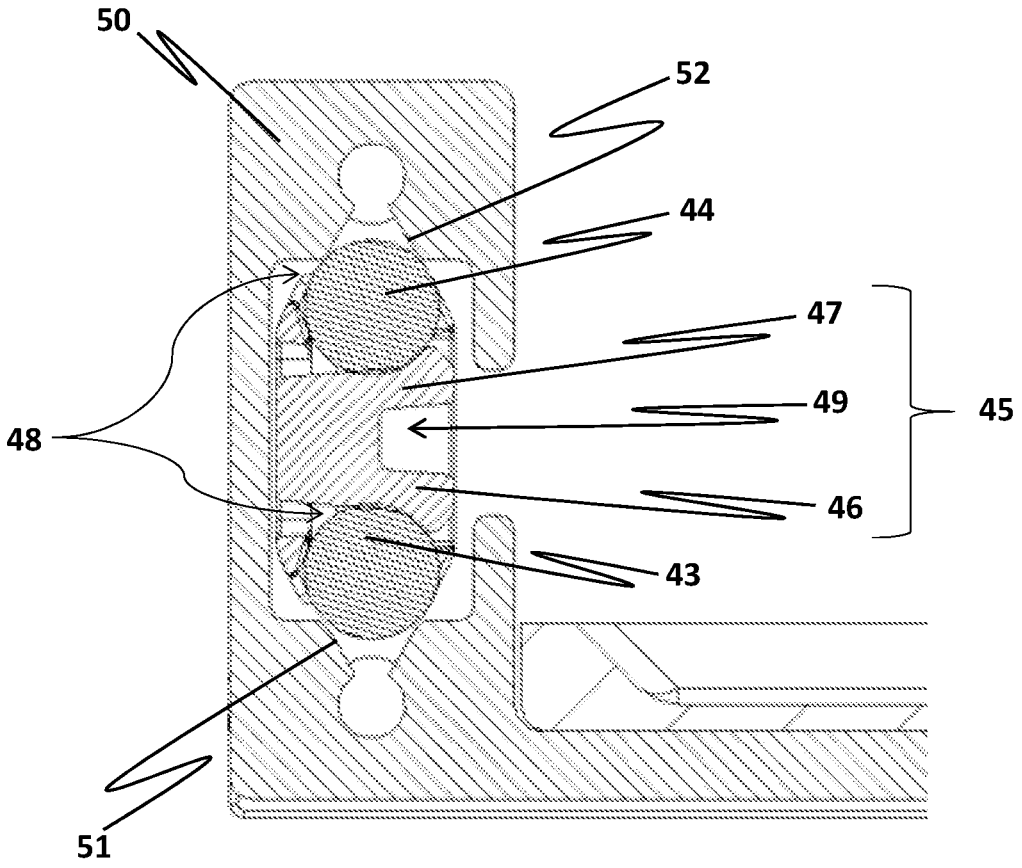
FIG. 6 is a cross-sectional view of the slider in the guiding rail according to the present invention.

As seen in FIG. 5, each slider arm 42 has oppositely oriented roller housings 48 for accommodating the first ball-shaped roller 43 and the second ball-shaped roller 44. Every ball-shaped roller 43, 44 is rotatably placed on the corresponding roller housings 48 formed on the slider 40. The first ball-shaped roller 43 is fitted into the roller housing 48 and is supported from above by the first flexible protrusion 46. The second ball-shaped roller 44 is fitted into the roller housing 48 and is supported from below by the second flexible protrusion 47. As seen in FIG. 5 and FIG. 6, the support member 45 has a recess 49 between the first flexible protrusion 46 and the second flexible protrusion 47.

Referring to FIG. 7, each slider arm 42 has at least one cut-out portion 60 for providing a predetermined thickness. Moreover, each slider arm 42 has two cut-out portions 60 for eliminating the use of extra material and obtaining the predetermined thickness all over the slider arm 42.

Figure 3:
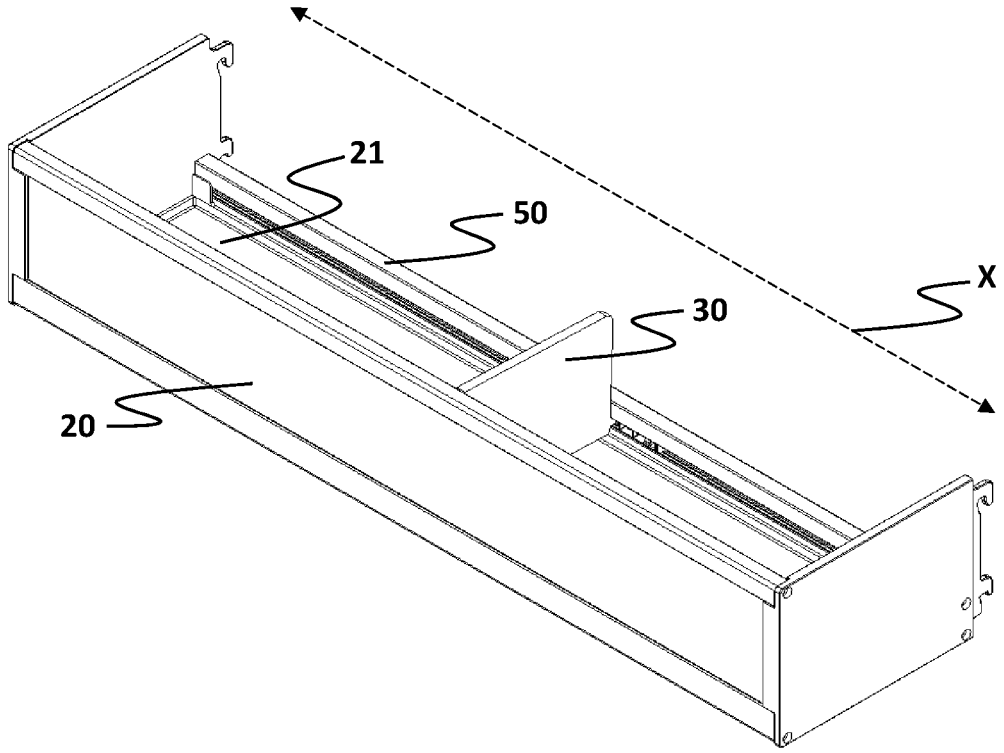
FIG. 3 is a perspective view of the storage container including the divider assembly according to the present invention.

Referring to FIG. 3, the guiding rail 50 almost extends along with the storage container 20. Referring to FIG. 6, the guiding rail 50 has a C-shaped cross-section. The first surface 51 of the guiding rail 50 is formed on the lower surface of the guiding rail 50 so as to face the second surface 52 which is formed on the upper surface of the guiding rail 50.

Figure 2:
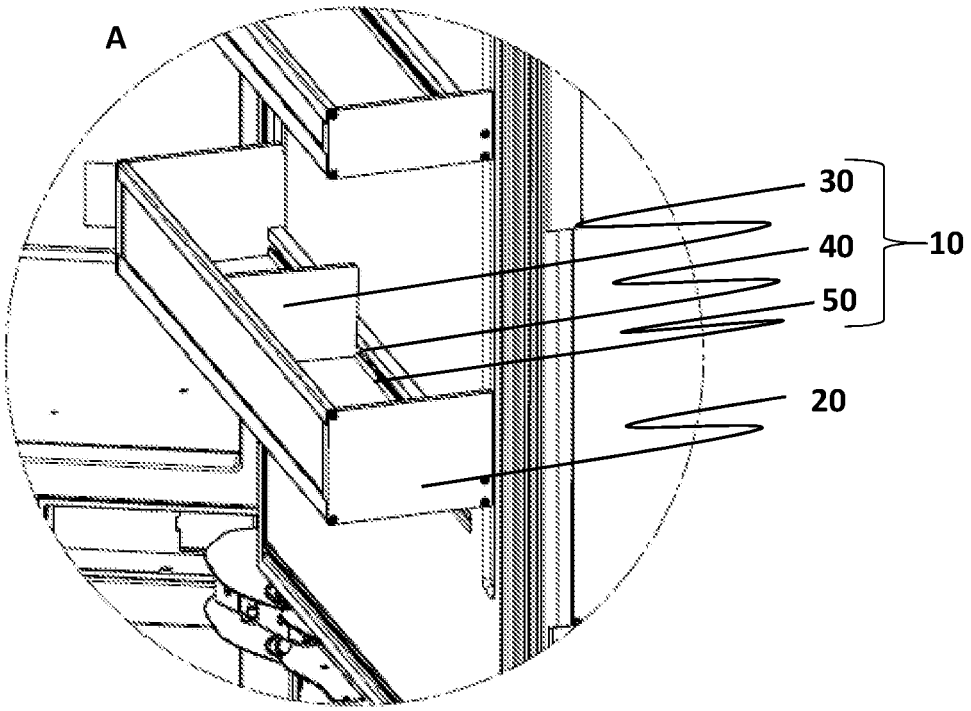
FIG. 2 is a fragmentary, enlarged perspective view of the detail A in FIG. 1.

As seen in FIG. 1 and FIG. 2, a cooling device 1 includes the divider assembly 10. The cooling device 1 has a body 2, a door 3 providing access into the body 2, and the storage container 20 mounted onto the door 3. The divider 30 supports articles in the storage container 20 and prevents the articles from being tilted over while opening and/or closing the door 3. The storage container 20 has a bottom wall 21 which extends perpendicularly with respect to the door 3 when the storage container 20 is mounted onto the door 3 and the guiding rail 50 is disposed in the vicinity of a rear edge where the door 3 intersects the bottom wall 21. Thus, the usage volume of the storage container 20 is increased.

The following is a summary list of reference numerals and the corresponding structure used in the above description of the invention:

1. Cooling device
2. Body
3. Door
10. Divider assembly
20. Storage container
21. Bottom wall
30. Divider
31. Connection tab
40. Slider
41. Tab housing
42. Slider arm
43. First ball-shaped roller
44. Second ball-shaped roller
45. Support member
46. First flexible protrusion
47. Second flexible protrusion
48. Roller housing
49. Recess
50. Guiding rail
51. First surface
52. Second surface
60. Cut-out portion
X. Sliding direction

The invention claimed is:

1. A divider assembly to be mounted in a storage container for dividing the storage container during use, the divider assembly comprising:

a guiding rail having a first surface and a second surface aligned facing each other and extending in a sliding direction;

a slider slidably movable in said guiding rail;

a divider attached to said slider and movable with said slider in the storage container for dividing the storage container into sections;

said slider including:

at least two slider arms extending in opposite directions, each slider arm having at least one ball-shaped roller, said ball-shaped rollers rolling on at least one of said first surface or said second surface of said guiding rail when said slider moves in the sliding direction; said at least one ball-shaped roller including first and second ball-shaped rollers; and at least one support member disposed on said slider so as to support at least one of said first ball-shaped roller toward said first surface of said guiding rail or so as to support said second ball-shaped roller toward said second surface of said guiding rail, said support member including a first flexible protrusion supporting said first ball-shaped roller against said first surface of said guiding rail and a second flexible protrusion supporting said second ball-shaped roller against said second surface of said guiding rail.

2. The divider assembly according to claim 1, wherein:

each slider arm has at least one first ball-shaped roller rolling on said first surface of said guiding rail when said divider moves in the sliding direction; and at least one slider arm has at least one second ball-shaped roller rolling on said second surface of said guiding rail when said divider moves in the sliding direction.

3. The divider assembly according to claim 1, wherein said slider has a tab housing into which said divider is attached.

4. The divider assembly according to claim 3, wherein said divider has a connection tab for connection of said divider to said tab housing.

5. The divider assembly according to claim 1, wherein said support member has a recess between said first flexible protrusion and said second flexible protrusion.

6. The divider assembly according to claim 1, wherein each slider arm has oppositely oriented roller housings for accommodating said first ball-shaped roller and said second ball-shaped roller.

7. The divider assembly according to claim 1, wherein each slider arm has at least one cut-out portion for providing a predetermined thickness.

8. The divider assembly according to claim 1, wherein said guiding rail is configured to extend along said storage container.

9. The divider assembly according to claim 1, wherein said guiding rail has a C-shaped cross-section.

10. A cooling device, comprising the divider assembly according to claim 1.

11. The cooling device according to claim 10, which further comprises a body, a door providing access into said body, and a storage container mounted onto said door.

12. The cooling device according to claim 11, wherein said storage container mounted onto said door has a bottom wall extending perpendicularly relative to said door upon mounting said storage container onto said door, said door intersects said bottom wall at a rear edge, and said guiding rail is disposed on said rear edge.

* * * * *